US010319284B2

(12) United States Patent
So et al.

(10) Patent No.: US 10,319,284 B2
(45) Date of Patent: Jun. 11, 2019

(54) DISPLAY DEVICE INCLUDING A SHIFT REGISTER INCLUDING A PLURARALITY OF STAGES CONNECTED AS A CASCADE AND METHOD OF OPERATING THE SAME

(71) Applicant: LG Display Co., Ltd., Seoul (KR)

(72) Inventors: Byeongseong So, Gyeonggi-do (KR); Youngsung Cho, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 89 days.

(21) Appl. No.: 15/630,136

(22) Filed: Jun. 22, 2017

(65) Prior Publication Data

US 2017/0372654 A1 Dec. 28, 2017

(30) Foreign Application Priority Data

Jun. 27, 2016 (KR) ..... 10-2016-0080334

(51) Int. Cl.
*G09G 3/20* (2006.01)
*G09G 3/3266* (2016.01)
*G09G 3/36* (2006.01)

(52) U.S. Cl.
CPC ..... *G09G 3/2092* (2013.01); *G09G 3/3266* (2013.01); *G09G 3/3677* (2013.01); (Continued)

(58) Field of Classification Search
CPC ..... G09G 3/2092; G09G 3/3266; G09G 3/3674–3681; G09G 2300/0421; G09G 2300/0426; G09G 2300/0823; G09G 2310/0243–0251; G09G 2310/0267; G09G 2310/0283; G09G 2310/0286; G09G 2310/061–063
See application file for complete search history.

(56) References Cited

U.S. PATENT DOCUMENTS

2010/0007653 A1 1/2010 Ahn et al.
2012/0139881 A1* 6/2012 Kwon ..... G09G 3/3677 345/204
2015/0371716 A1* 12/2015 Shao ..... G11C 19/287 345/100

FOREIGN PATENT DOCUMENTS

KR 10-2016-0069046 A 6/2016

OTHER PUBLICATIONS

Extended European Search Report dated Oct. 12, 2017, issued in corresponding European Application No. 17177680.0.

* cited by examiner

*Primary Examiner* — Nathan Danielsen
(74) *Attorney, Agent, or Firm* — Morgan, Lewis & Bockius LLP

(57) ABSTRACT

A display device includes: a pixel array including pixels at intersections of data lines and gate lines, a shift register including stages connected as a cascade, the shift register sequentially supplying gate pulses to the gate lines, and a node controller controlling nodes in the shift register, a first stage including: a pull-up transistor charging the output based on a Q node for a first gate pulse, a pull-down transistor discharging the output to a gate-low voltage based on a QB node voltage, a start controller pre-charging the Q node, and a QB node discharge controller discharging the QB node to a first low-potential voltage based on a first reset signal input line (IL), the node controller including a first reset signal generator that, during a vertical blanking interval of each frame, charges the first reset signal IL in response to a turn-on voltage applied to a gate-low voltage IL.

16 Claims, 8 Drawing Sheets

(52) U.S. Cl.
CPC ..... *G09G 2300/0426* (2013.01); *G09G 2300/0823* (2013.01); *G09G 2310/0248* (2013.01); *G09G 2310/0267* (2013.01); *G09G 2310/0286* (2013.01); *G09G 2310/061* (2013.01)

DISPLAY DEVICE INCLUDING A SHIFT REGISTER INCLUDING A PLURARALITY OF STAGES CONNECTED AS A CASCADE AND METHOD OF OPERATING THE SAME

CROSS-REFERENCE TO RELATED APPLICATIONS

This application claims the priority of Korean Application No. 10-2016-0080334, filed on Jun. 27, 2016, the entirety of which is hereby incorporated by reference.

BACKGROUND

1. Technical Field

The present disclosure relates to a display device, and, more particularly, to a display device with drive circuits of reduced size and a driving method thereof.

2. Discussion of the Related Art

In a display device, data lines and gate lines are arranged to intersect, e.g., at right angles, and pixels are arranged in a matrix. Video data voltages to be displayed are applied to the data lines, and gate pulses are sequentially supplied to the gate lines. Pixels on display lines to which gate pulses are supplied are supplied with video data voltages, and video data is displayed as the display lines are sequentially scanned by the gate pulses.

A gate driver for supplying gate pulses to the gate lines on the display device includes a plurality of gate drive integrated circuits (ICs). Each gate drive IC includes a shift register to sequentially output gate pulses, and may include circuits and output buffers for adjusting the output voltage of the shift register according to the driving characteristics of the display panel.

In the display device, the gate driver that generates gate pulses, e.g., scan signals, may be implemented in the form of a gate-in-panel (GIP) having a combination of thin-film transistors on the bezel of the display panel where no image is displayed. The GIP-type gate driver has a number of stages corresponding to the number of gate lines, and the stages output gate pulses to the gate lines on a one-to-one basis.

A GIP-type shift register can reduce the manufacturing costs of drive circuits because it can take the place of a gate drive IC. However, the increasing complexity of GIP circuits often increases the number of driving signals applied to the GIP circuits. Applying more driving signals to GIP requires the addition of more circuits for generating those driving signals. This results in an increase in the size of circuits in display devices, and redesigning should be done to connect drive circuits and a GIP circuit section.

SUMMARY

Accordingly, the present disclosure is directed to a display device and a method of operating the same that substantially obviate one or more of the issues due to limitations and disadvantages of the related art.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided a display device, including: a pixel array including: data lines and gate lines, and pixels in a matrix, the pixels being at intersections of the data lines and gate lines, a shift register including a plurality of stages connected as a cascade, the shift register being configured to sequentially supply respective gate pulses to the gate lines, and a node controller configured to control nodes in the shift register, wherein a first stage among the plurality of stages includes: a pull-up transistor configured to charge the output in response to a voltage on a Q node to output a first gate pulse, a pull-down transistor configured to discharge the output to a gate-low voltage in response to a QB node voltage, a start controller configured to pre-charge the Q node in response to a start pulse or a gate pulse other than the first gate pulse, and a QB node discharge controller configured to discharge the QB node to a first low-potential voltage in response to a voltage at a first reset signal input line, wherein the node controller includes a first reset signal generator including: a gate electrode connected to a gate-low voltage input line, a drain electrode connected to a high-potential voltage input line, and a source electrode connected to the first reset signal input line, wherein the first reset signal generator is configured to, during a vertical blanking interval of each frame, charge the first reset signal input line in response to a turn-on voltage applied to the gate-low voltage input line.

In another aspect, there is provided a method of operating a display device including a pixel array including data lines and gate lines and pixels in a matrix, the pixels being at intersections of the data lines and gate lines, the method including: by a shift register including a plurality of stages connected as a cascade, sequentially supplying respective gate pulses to the gate lines, by a node controller, controlling nodes in the shift register, the node controller including: wherein the node controller includes a first reset signal generator including: a gate electrode connected to a gate-low voltage input line, a drain electrode connected to a high-potential voltage input line, and a source electrode connected to the first reset signal input line, by a pull-up transistor in a first stage among the plurality of stages, charging the output in response to a voltage on a Q node to output a first gate pulse, by a pull-down transistor in the first stage, discharging the output to a gate-low voltage in response to a QB node voltage, by a start controller in the first stage, pre-charging the Q node in response to a start pulse or a gate pulse other than the first gate pulse, by a QB node discharge controller in the first stage, discharging the QB node to a first low-potential voltage in response to a voltage at a first reset signal input line, by the first reset signal generator, during a vertical blanking interval of each frame, charging the first reset signal input line in response to a turn-on voltage applied to the gate-low voltage input line.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain various principles of the disclosure.

Figure 1:
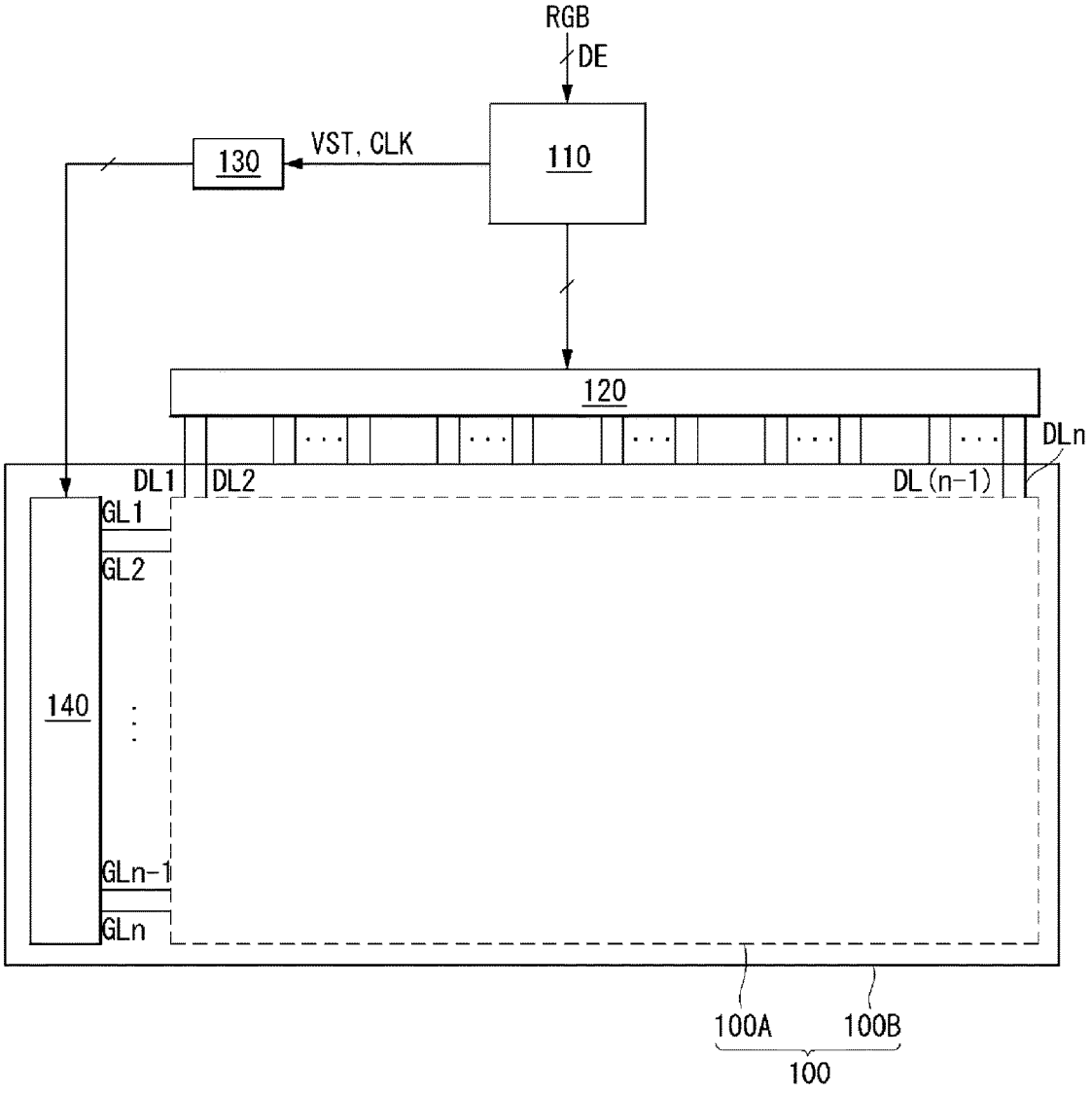
FIG. 1 is a block diagram of a display device according to an embodiment.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to some embodiments of the present disclosure, examples of which are illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

In the description of embodiments, when a structure is described as being positioned "on or above" or "under or below" another structure, this description should be construed as including a case in which the structures contact each other as well as a case in which a third structure is disposed therebetween.

Switching elements of a gate driver according to embodiments may be implemented as transistors of n-type or p-type metal oxide semiconductor field effect transistor (MOSFET) structure. In embodiments disclosed herein, n-type transistors are described by way of example. However, embodiments are not limited thereto, and other types of transistors may be used. The transistor is a three-electrode element including a gate, a source, and a drain. The source is an electrode for supplying carriers to the transistor. The carriers inside the transistor may begin to flow from the source. The drain is an electrode from which the carriers exit the transistor. For example, carriers in the MOSFET flow from the source to the drain. In case of an n-type MOSFET (NMOS), because carriers are electrons, a source voltage is less than a drain voltage so that electrons can flow from a source to a drain. In the n-type MOSFET, because electrons flow from the source to the drain, a current flows from the drain to the source. In case of a p-type MOSFET (PMOS), because carriers are holes, a source voltage is greater than a drain voltage so that holes can flow from a source to a drain. In the p-type MOSFET, because holes flow from the source to the drain, a current flows from the source to the drain. In embodiments disclosed herein, the source and the drain of the MOSFET are not fixed. For example, the source and the drain of the MOSFET may be changed, depending on an applied voltage. The following embodiments relate to the source and the drain of the transistor.

"Turn-on voltage" refers to the operating voltage of a transistor. Example embodiments are described with respect to an n-type transistor, and thus the turn-on voltage is defined as high-potential voltage. However, embodiments are not limited thereto.

FIG. 1 is a block diagram of a display device according to an embodiment.

With reference to FIG. 1, a display device may include a display panel 100, a timing controller 110, a data driver 120, and a gate driver 130 and 140. The display panel 100 may include a pixel array 100A in which data lines DL1 to DLn and gate lines GL1 to GLn may be defined and pixels may be disposed, and a non-display area 100B around the pixel array 100A where various signal lines or pads are disposed. A liquid crystal display (LCD), an organic light-emitting diode display (OLED), an electrophoresis display (EPD), etc. may be used for the display panel 100.

The timing controller 110 may receive timing signals, such as a vertical synchronization signal (Vsync), a horizontal synchronization signal (Hsync), a data enable signal DE, and a dot clock (DCLK), e.g., through a low-voltage differential signaling (LVDS) or transition-minimized differential signaling (TMDS) interface receiver circuit connected to a video board. Based on an input timing signal, the timing controller 110 may generate data timing control signals (DDC) for controlling the operation timing of the data driver 120 and gate timing control signals (GDC) for controlling the operation timing of the gate driver 130 and 140.

The data timing control signals may include a source start pulse (SSP), a source sampling clock (SSC), a polarity control signal (POL), a source output enable signal (SOE), etc. The source start pulse (SSP) may control the shift start timing of the data driver 120. The source sampling clock (SSC) is a clock signal that may control the timing of data sampling in the data driver 120 with respect to the rising edge or falling edge.

The gate timing control signals may include a start pulse VST, a gate clock CLK, etc. The start pulse VST may be input into a shift register SR (see FIG. 2) to control the shift start timing. The gate clock CLK may be level-shifted by the level shifter 130, and then may be input into the shift register SR.

The data driver 120 may include a plurality of source drive integrated circuits ICs. The source drive ICs may receive digital video data RGB and a source timing control signal (DDC) from the timing controller 110. The source drive ICs may convert digital video data RGB into gamma voltages in response to the source timing control signal (DDC) to produce data voltages, and may supply the gamma voltages through the data lines DL on the display panel 100.

The gate driver 130 and 140 may include the level shifter 130 and a GIP circuit section 140.

The level shifter 130 may be formed on a printed circuit board (not shown) that may be connected to the display panel 100, e.g., in the form of IC. The level shifter 130 may level-shift clock signals CLK and start signal VST by the control of the timing controller 110, and then may supply them to the shift register SR.

Figure 2:
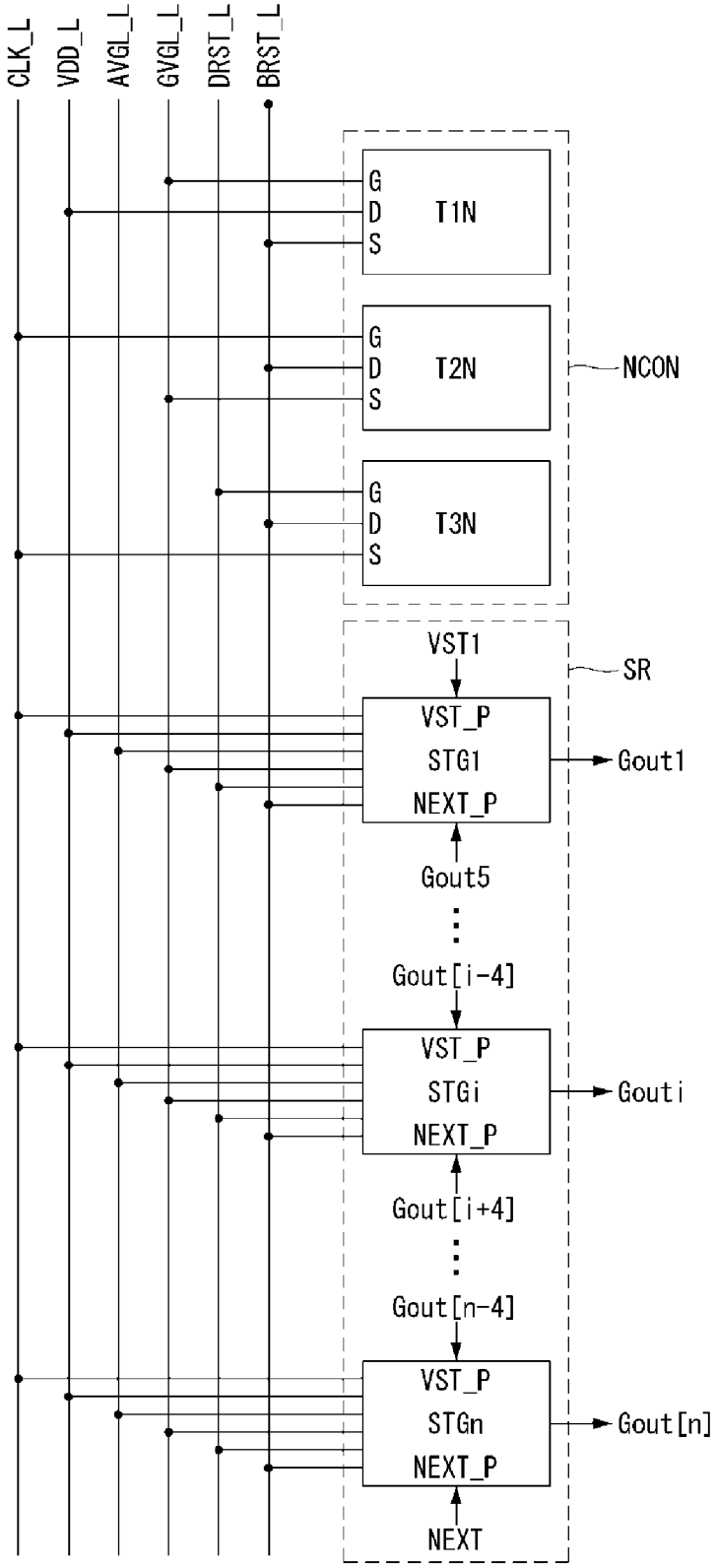
FIG. 2 is a view of a GIP circuit section according an embodiment.

FIG. 2 is a view of a GIP circuit section according to an embodiment.

With reference to FIG. 2, the GIP circuit section 140 may include a combination of a plurality of thin-film transistors (TFTs) in the non-display area 100B of the display panel 100, using the gate-in-panel (GIP) technology, and may sequentially output gate pulses. To this end, the GIP circuit section 140 may include a node controller NCON and a shift register SR.

A plurality of signal lines CLK_L, VDD_L, AVGL_L, GVGL_L, and DRST_L to be supplied with driving signals and driving voltages from the timing controller 110 or a power supply part may be provided at one side of the GIP circuit section 140. Meanwhile, a first reset signal input line BRST_L may not be connected to other circuit sections, but may be configured to be disconnected, e.g., "float," in the display panel 100.

The node controller NCON may control the voltage level of the nodes in the shift register SR. For example, the node controller NCON may control the node of the first reset signal input line BRST_L. The node controller NCON may include a first reset signal generator T1N, a first reset voltage holder T2N, and a first reset line discharge controller T3N.

The first reset signal generator T1N may include a transistor including a gate electrode G connected to the gate-low voltage input line GVGL_L, a drain electrode D connected to the high-potential voltage input line VDD_L, and a source electrode S connected to the first reset signal input line BRST_L. The first reset signal generator T1N may apply a high-potential voltage VDD (see FIG. 3) that is input from the high-potential voltage input line VDD_L to the first reset signal input line BRST_L, in response to a turn-on voltage input into the gate-low voltage input line GVGL_L. The gate-low voltage input line GVGL_L may maintain the turn-on voltage during the vertical blanking interval VB of each frame, and may maintain a turn-off voltage during the active period AT (see FIG. 4).

The first reset line voltage holder T2N may include a gate electrode G connected to the input line of the $[i-4]^{th}$ gate clock CLK[i−4] (see FIG. 3), a drain electrode D connected to the first reset signal input line BRST_L, and a source electrode S connected to the gate-low voltage input line GVGL_L.

The first reset line discharge controller T3N may include a gate electrode G connected to the second reset signal input line DRST_L, a drain electrode D connected to the first reset signal input line BRST_L, and a source electrode S connected to the gate-low voltage input line GVGL_L. A second reset signal DRST may be input at the initial stage of the active period AT after the end of the vertical blanking interval VB, and a second low-potential voltage VSS2 may be input into the gate-low voltage input line GVGL_L during the active period AT. As a result, when the active period AT begins, the first reset line discharge controller T3N may discharge the first reset signal input line BRST_L to the second low-potential voltage VSS2, in response to the second reset signal DRST.

The shift register SR may output gate pulses, e.g., corresponding to gate clocks CLK and start pulses VST. The shift register SR may include a plurality of stages connected as a cascade. Although FIG. 2 depicts a shift register SR having n stages STG corresponding to n gate lines, the number of stages STG is not limited to this. For example, the stages may include a dummy stage that generates a carry signal or a succeeding signal NEXT. In what follows, "preceding stage" refers to a stage positioned above (or before) a reference stage. For example, a preceding stage indicates one of the first stage STG1 to $(i-1)^{th}$ stage STG(i−1), with respect to the $i^{th}$ stage STGi (i being a natural number, where $1<i<n$). "Succeeding stage" refers to a state positioned below (or after) the reference stage. For example, a succeeding stage indicates one of the $[i+1]^{th}$ stage STG(i+1) to $n^{th}$ stage, with respect to the $i^{th}$ stage STGi.

The stages STG of the shift register SR may sequentially output gate pulses Gout[1] to Gout[n]. For example, the $i^{th}$ stage STGi may output the $i^{th}$ gate pulse Gouti, and the $n^{th}$ stage STGn may output the nth gate pulse Gout[n]. To this end, the stages STG may receive one of the gate clocks CLK that may be sequentially delayed.

The $[i-4]^{th}$ gate pulse Gout[i−4] may be applied to the $[i-4]^{th}$ gate line, and also may serve as a carry signal that is passed to the $i^{th}$ stage STGi. The $[i+4]^{th}$ gate pulse Gout[i+4] may be applied to the $[i+4]^{th}$ gate line, and also may serve as a succeeding signal NEXT that may be applied to the $i^{th}$ stage STGi. FIG. 2 is an example in which the gate clocks CLK have eight phases and the gate pulses overlap during 4 horizontal periods H, as shown in the FIG. 4 example, but embodiments are not limited thereto. The carry signal and the succeeding signal NEXT are described with respect to the FIG. 2 example.

Figure 3:
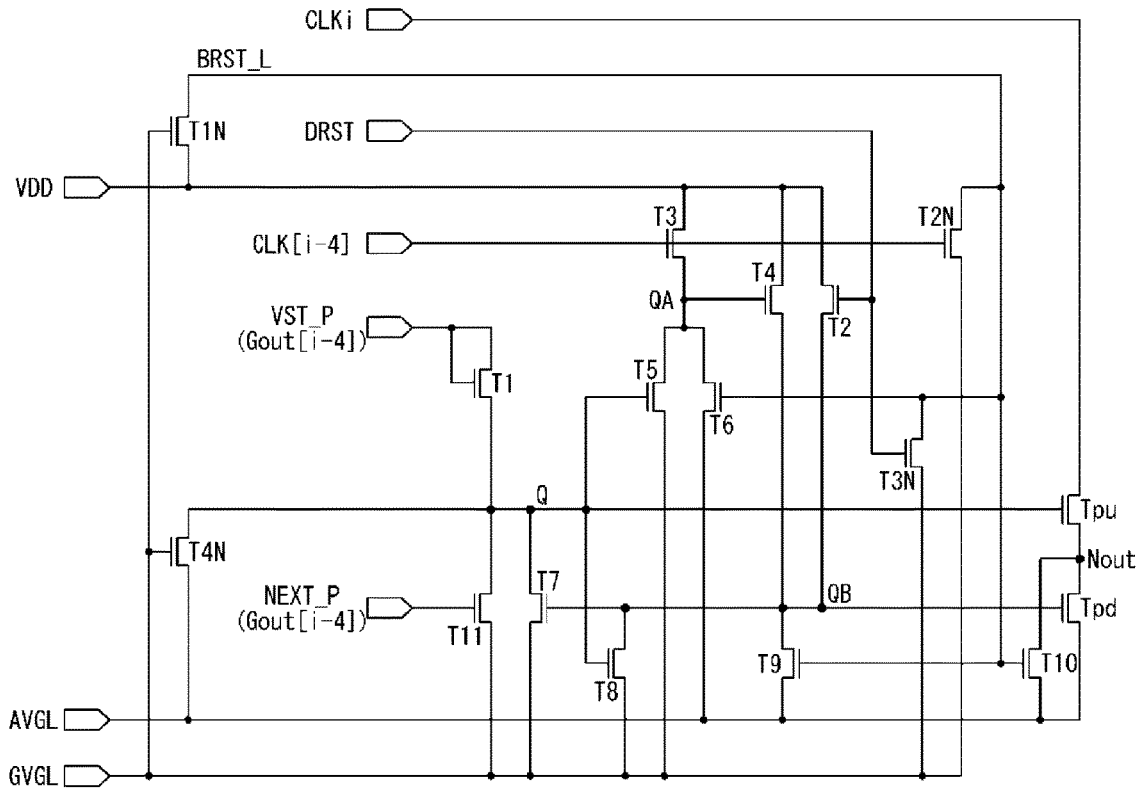
FIG. 3 is a view of a stage shown in FIG. 2.
Figure 4:
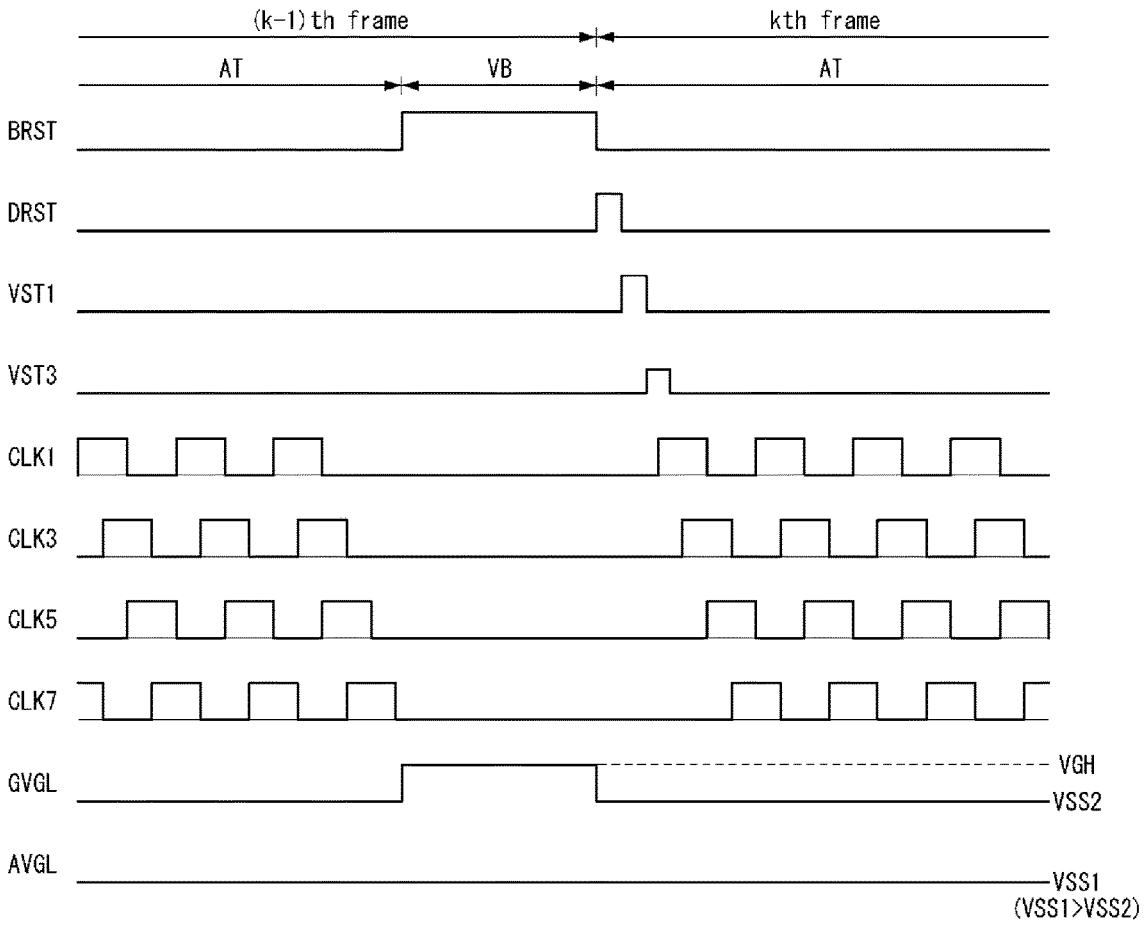
FIG. 4 is a timing diagram of inputs to and outputs from a GIP circuit section according an embodiment.

FIG. 3 is a view of a stage shown in FIG. 2. FIG. 4 is a timing diagram of inputs to and outputs from a GIP circuit section according an embodiment.

FIG. 3 is a view showing a configuration of one of the stages shown in FIG. 2. FIG. 4 is a view showing the timings of driving signals input into the stage of FIG. 3 and output signals. Although FIG. 3 depicts the node controller of FIG. 2 to show a connection to the stage, the node controller may not be provided at every stage as mentioned above.

With reference to FIGS. 1 to 4, the $i^{th}$ stage STGi may include a pull-up transistor Tpu, a pull-down transistor Tpd, a start controller transistor T1, and a plurality of other transistors. The pull-up transistor Tpu may include a gate electrode connected to a Q node, a drain electrode connected to the input of a gate clock CLK, e.g., for receiving an $i^{th}$ clock signal CLKi, and a source electrode connected to the output Nout. The pull-down transistor Tpd may include a gate electrode connected to a QB node, a drain electrode connected to the output Nout, and a source electrode connected to a gate-low voltage input GVGL.

The start controller transistor T1 may include gate and drain electrodes connected to a start pulse input terminal VST_P and a source electrode connected to the Q node. The start pulse input terminal VST_P may receive one of first to fourth start pulses VST1 to VST4 or a carry signal. The start pulse input terminals VST_P of the first to fourth stages STG1 to STG4 may receive the first to fourth start pulses VST1 to VST4, respectively, and the start pulse input terminal VST_P of the $i^{th}$ stage STGi may receive the $[i-4]^{th}$ gate pulse Gout[i−4], which is a carry signal.

A second transistor T2 may include a gate electrode connected to the second reset signal input line DRST_L, a drain electrode connected to the high-potential voltage input line VDD_L, and a source electrode connected to the QB node. The second transistor T2 may charge the QB node in response to the second reset signal DRST.

A third transistor T3 may include a gate electrode that may receive a gate clock bar signal, e.g., CLK[i−4], a drain electrode connected to the high-potential voltage input line VDD_L, and a source electrode connected to a QA node. The gate clock bar signal refers to a gate clock that is opposite in phase to the gate clock applied to the drain electrode of the pull-up transistor Tpu. In a shift register using an 8-phase gate clock, as in an example embodiment, the gate clock bar signal of the $i^{th}$ stage STGi refers to the $[i-4]^{th}$ gate clock CLK[i−4]. The third transistor T3 may charge the QA node in response to the $[i-4]^{th}$ gate clock CLK[i−4].

A fourth transistor T4 may include a gate electrode connected to the QA node, a drain electrode connected to the high-potential voltage input line VDD_L, and a source electrode connected to the QB node. The fourth transistor T4 may charge the QB node when the QA node is charged.

A fifth transistor T5 may include a gate electrode connected to the Q node, a drain electrode connected to the QA node, and a source electrode connected to the gate-low voltage input line GVGL_L. The fifth transistor T5 may form a current path between the QA node and the gate-low voltage input line GVGL_L when the Q node is charged.

A sixth transistor T6 may include a gate electrode connected to the first reset signal input line BRST_L, a drain electrode connected to the QA node, a source electrode connected to the low-potential voltage input line AVGL_L. The sixth transistor T6 may discharge the QA node to a first low-potential voltage VSS1 in response to the first reset signal BRST.

A seventh transistor T7 may include a gate electrode connected to the QB node, a drain electrode connected to the Q node, and a source electrode connected to the gate-low voltage input line GVGL_L. The seventh transistor T7 may discharge the QB node when the Q node is charged.

An eighth transistor T8 may include a gate electrode connected to the Q node, a drain electrode connected to the QB node, and a source electrode connected to the gate-low voltage input line GVGL_L. The eighth transistor T8 may discharge the Q node when the QB node is charged.

A QB node discharge controller T9 may include a gate electrode connected to the first reset signal input line BRST_L, a drain electrode connected to the QB node, and a source electrode connected to the low-potential voltage input line AVGL_L. The QB node discharge controller T9 may discharge the QB node to the first low-potential voltage VSS1 (see FIG. 4) in response to the first reset signal BRST. The QB node discharge controller T9 may discharge the QB node through the low-potential voltage input line AVGL_L because may operate when the first reset signal input line BRST_L is gate-high VGH (see FIG. 4).

A tenth transistor T10 may include a gate electrode connected to the first reset signal input line BRST_L, a drain electrode connected to the output Nout, and a source electrode connected to the low-potential voltage input line AVGL_L. The tenth transistor T10 may discharge the output Nout to the first low-potential voltage VSS1 in response to the first reset signal BRST.

An eleventh transistor T11 may include a gate electrode connected to a succeeding signal input NEXT_P, a drain electrode connected to the Q node, and a source electrode connected to the gate-low voltage input line GVGL_L. The eleventh transistor T11 may discharge the voltage of the Q node to the second low-potential voltage VSS_2 in response to a succeeding signal NEXT. A Q node discharge controller T4N may include a gate electrode connected to the gate-low voltage input line GVGL_L, a drain electrode connected to the Q node, and a source electrode connected to the low-potential voltage input line AVGL_L.

Figure 5:
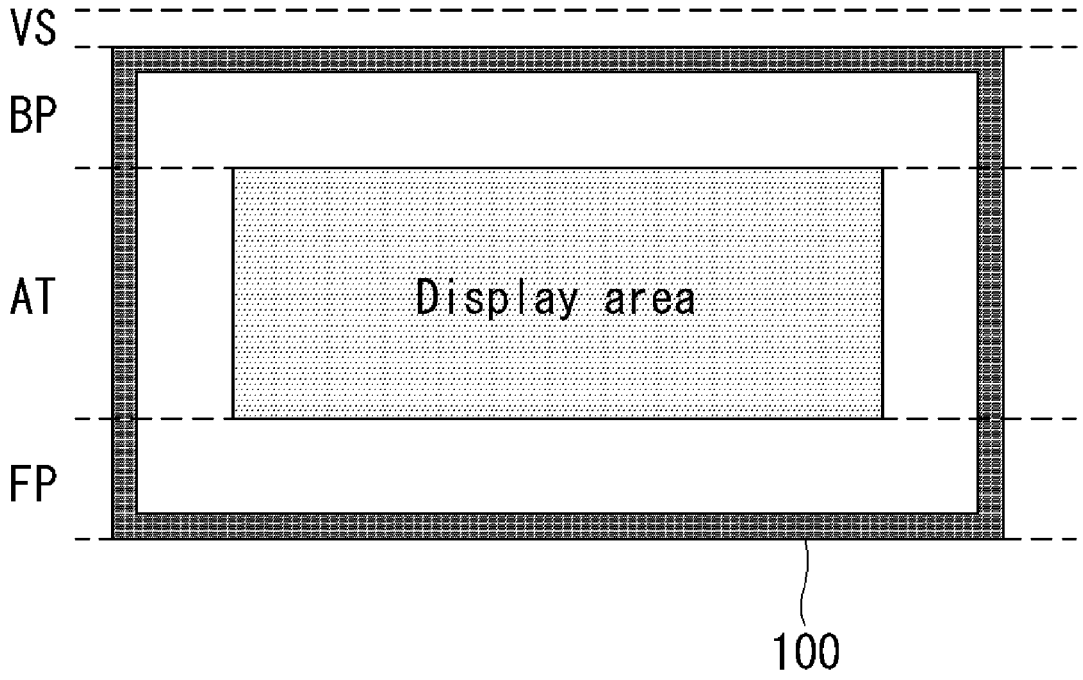
FIG. 5 is a view for explaining a frame period.

FIG. 5 is a view for explaining a frame period.

The operation of the GIP circuit section 140 with the above configuration will be described as follows. A frame period may be divided into an active period AT and a vertical blanking interval VB. FIG. 5 is a view of an active period and a vertical blanking interval based on the VESA (Video Electronics Standards Association) standards.

With reference to FIG. 5, the active period AT is the time taken for the display panel 100 to display an amount of data equal to one (1) frame on all pixels in the display area 100A where an image is displayed. The vertical blanking interval VB may include a vertical sync time (VS), a vertical front porch (FP), and a vertical back porch (BP). The vertical sync time VS is the time between the falling edge of Vsync and the rising edge, indicating the start (or end) timing of a picture. The vertical front porch FP is the time between the falling edge of the last DE, which is the data timing of the final line of one frame, and the start of the vertical blanking interval VB. The vertical back porch BP is the time between the end of the vertical blanking interval VB and the rising edge of the first DE, which is the data timing of the first line of one frame.

During the vertical blanking interval VB, a gate-high voltage VGH is applied to the gate-low voltage input line GVGL_L. The first reset signal generator T1N may turn on in response to the gate-high voltage VGH, and may charge the first reset signal input line BRST_L with the high-potential voltage VDD. In this way, the first reset signal input line BRST_L may receive the first reset signal BRST through the first reset signal generator T1N located in the GIP circuit section 140, rather than from a separate drive circuit. Accordingly, the display device of this invention may reduce the size of the drive circuit that may generate the first reset signal. Because the first reset signal BRST may be generated from within the display panel 100, the first reset signal input line BRST_L may require no connection to a drive circuit outside the display panel. This allows for sufficient design margin between the GIP circuit section 140 of the display panel and separate drive circuits.

When the first reset signal input line BRST_L is charged with the high-potential voltage VDD, the QB node discharge controller T9 and the tenth transistor T10 may turn on. As the QB node discharge controller T9 turns on, it may discharge the QB node to the first low-potential voltage VSS1, and the tenth transistor T10 may discharge the output Nout to the first low-potential voltage VSS1.

In this way, the gate-high voltage VGH applied to the gate-low voltage input line GVGL_L during the vertical blanking interval VB may cause the QB node and output Nout of each stage STG to be reset to the first low-potential voltage VSS1. Because the QB node may maintain the first low-potential voltage VSS1, the pull-down transistor Tpd and the seventh transistor T7 may remain turned off, and thus they may be subjected to less stress. After the end of the vertical blanking interval VB of the $(k-1)^{th}$ frame (k being a natural number), the second reset signal input line DRST_L may receive the second reset signal DRST during the initial period of the kth frame.

The first reset line discharge controller T3N may form a current path between the reset signal input line BRST_L and the gate-low voltage input line GVGL_L in response to the second reset signal DRST. Because the second low-potential voltage VSS2 may be input into the gate-low voltage input line GVGL_L after the end of the vertical blanking interval VB, the first reset line discharge controller T3N may discharge the first reset signal input line BRST_L to the second low-potential voltage VSS2 in response to the second reset signal DRST.

While the second reset signal DRST is applied, the second transistor T2 may turn on to charge the QB node. Because the QB node may maintain the first low-potential voltage VSS1 during the vertical blanking interval VB, the Q node may float. The second transistor T2 may charge the QB node in response to the second reset signal DRST, and the seventh transistor T7 may discharge the Q node. As a result, the first reset line discharge controller T3N may prevent the Q node from floating by keeping the Q node at the second low-potential voltage VSS2 before input of a gate clock CLK.

The start controller T1 may pre-charge the Q node in response to a start pulse VST. The start controllers T1 arranged at the first to fourth stages STG1 to STG4 may receive the first to fourth start pulses VST1 to VST4, respectively, and the start controllers T1 at the fifth to $i^{th}$ stages STG5 to STGi may receive the gate pulse output from the $[i-4]^{th}$ stage.

When a gate clock CLK is input into the drain electrode of the pull-up transistor Tpu while the Q node is in the pre-charged state, the voltage at the drain electrode of the pull-up transistor Tpu may rise, thus allowing the Q node to be bootstrapped. As the Q node is bootstrapped, the potential difference between the gate and source of the pull-up transistor Tpu may increase. As a result, the pull-up transistor Tpu may turn on when the voltage difference between the gate and source reaches a threshold voltage. The turned-on pull-up transistor Tpu may charge the output Nout by using the gate clock CLK. The output Nout of the $i^{th}$ stage STGi may be connected to the $i^{th}$ gate line GLi, and the gate pulse Gouti may be applied to the $i^{th}$ gate line GLi.

The gate electrode of the eleventh transistor T11 may receive a succeeding signal NEXT after the gate clock CLK is inverted to low level. The Q node discharge controller T6 may turn on in response to the succeeding signal NEXT. As a result, the voltage at the Q node may be discharged to the low-potential voltage VSS1.

Figure 6:
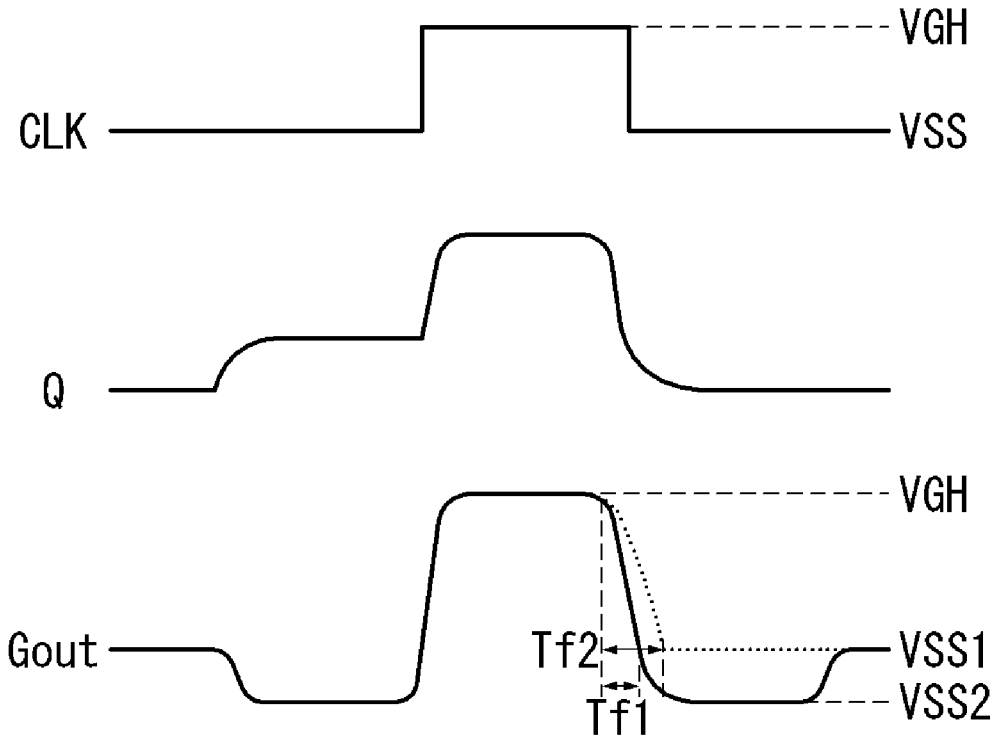
FIG. 6 is a waveform diagram illustrating a fall time of a gate pulse.

The gate-low voltage of the gate clock CLK may be set to the second low-potential voltage VSS2, which may be lower than the first low-potential voltage VSS1. As a result, the fall time of the gate pulse Gout may be reduced during discharge of the Q node, as shown in FIG. 6. This is because, the larger the voltage difference, the faster the discharge. Thus, the fall time Tf1, during which the gate clock may decrease to the second low-potential voltage VSS2, may be shorter than the fall time Tf2, during which the gate clock may decrease to the first low-potential voltage VSS1. Therefore, the fall time of the gate pulse Gout may be reduced.

Within the active period, the third transistor T3 may charge the QA node in response to the $[i-4]^{th}$ gate clock CLK[i−4]. That is, the QA node may maintain the high-potential voltage VDD in the period during which the $i^{th}$ gate clock CLKi is not input. The fourth transistor T4 may charge the QB node in response to the voltage at the QA node. The $i^{th}$ gate clock CLKi refers to the gate clock CLK that is applied to the drain electrode of the pull-up transistor Tpu to determine the output timing of the gate pulse output from the $i^{th}$ stage STGi.

The fifth transistor T5 may keep the fourth transistor T4 from operating in the period during which the Q node is charged. That is, the fifth transistor T5 may discharge the QA node while the start pulse VST and the $i^{th}$ gate clock CLKi are input to keep the fourth transistor T4 from operating.

The first reset line voltage holder T2N may discharge the first reset signal input line BRST_L to the second low-potential voltage VSS2 in response to the $[i-4]^{th}$ gate clock CLK[i−4]. Because the first reset signal generator T1N may be turned off during the active period AT, the first reset signal input line BRST_L may float during the active period AT. The first reset line voltage holder T2N may discharge the first reset signal input line BRST_L to the second-potential voltage VSS2 while the $i^{th}$ gate clock ClKi is not input, thereby preventing the first reset signal input line BRST_L from floating.

The sixth transistor T6 may discharge the QA node when the first reset signal input line BRST_L is at the high-potential voltage to keep the fourth transistor T4 from operating. The fourth transistor T4 may be subject to a lot of stress because it may be turned on for a long time during the active period AT. Because the fourth transistor T4 may not need to operate during the vertical blanking interval VB, the sixth transistor T6 may discharge the QA node during the vertical blanking interval VB to keep the fourth transistor T4 from operating. For example, the gate-high voltage VGH may be applied to the gate-low voltage input line GVGL_L during the vertical blanking interval VB. Thus, the sixth transistor T6 may be connected to the low-potential voltage input line AVGL_L. The Q node discharge controller T4N may discharge the Q node to the first low-potential voltage VSS1 during the vertical blanking interval VB to prevent the Q node from floating.

Figure 7:
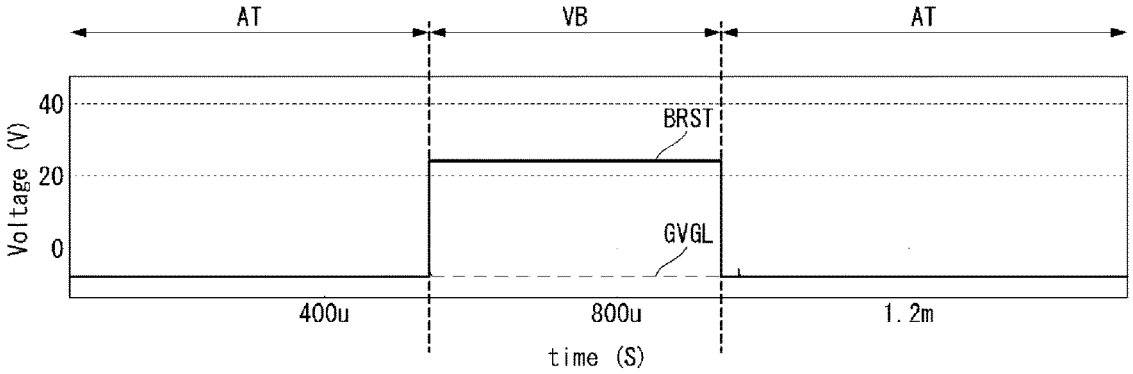
FIG. 7 is a waveform diagram of a simulation result of a first reset signal generated by the GIP circuit section according an embodiment.
Figure 8:
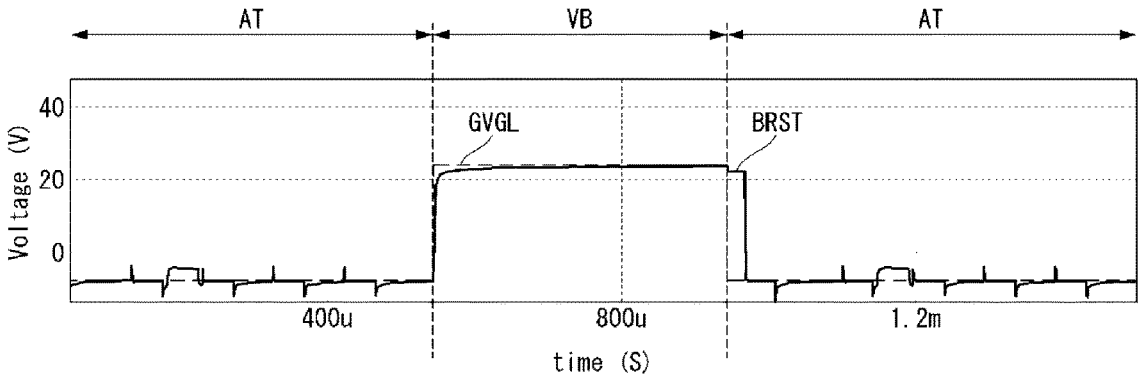
FIG. 8 (Related Art)
FIG. 8 is a timing diagram of a first reset signal generated by a drive circuit according to a comparative example.

FIG. 7 is a waveform diagram of a simulation result of a first reset signal generated by the GIP circuit section according an embodiment. FIG. 8 is a timing diagram of a first reset signal generated by a drive circuit according to a comparative example.

FIG. 7 is a waveform diagram of a simulation result of a first reset signal generated by a shift register according to an embodiment. FIG. 8 is a waveform diagram of a first reset signal generated in the related art by a drive circuit such as a timing controller. As shown in the FIG. 7 example, embodiments may allow for generating a first reset signal with the same level of reliability as in the conventional art, without using a separate drive circuit. That is, embodiments can reduce the size of drive circuits, provide sufficient design margin, and maintain the reliability of shift register operation.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. A display device, comprising:

a pixel array comprising:

data lines and gate lines; and pixels in a matrix, the pixels being at intersections of the data lines and gate lines;

a shift register comprising a plurality of stages connected as a cascade, the shift register being configured to sequentially supply respective gate pulses to the gate lines; and a node controller configured to control nodes in the shift register, wherein a first stage among the plurality of stages comprises:

a pull-up transistor configured to charge the output in response to a voltage on a Q node to output a first gate pulse, a pull-down transistor configured to discharge the output to a gate-low voltage in response to a QB node voltage, a start controller configured to pre-charge the Q node in response to a start pulse or a gate pulse other than the first gate pulse, and a QB node discharge controller configured to discharge the QB node to a first low-potential voltage in response to a voltage at a first reset signal input line, wherein the node controller comprises a first reset signal generator including:

a gate electrode connected to a gate-low voltage input line, a drain electrode connected to a high-potential voltage input line, and a source electrode connected to the first reset signal input line, wherein the first reset signal generator is configured to, during a vertical blanking interval of each frame, charge the first reset signal input line in response to a turn-on voltage applied to the gate-low voltage input line.

2. The display device of claim 1, wherein the first reset signal input line is configured to float when the first reset signal generator is turned off.

3. The display device of claim 1, wherein the node controller is at one side of the shift register in the display panel.

4. The display device of claim 1, wherein the gate-low voltage input line is further configured to receive a second low-potential voltage having a voltage level lower than the first low-potential voltage, except during the vertical blanking interval of each frame.

5. The display device of claim 4, wherein the second low-potential voltage is at a same voltage level as the low-potential voltage of a gate clock applied to the drain electrode of the pull-up transistor.

6. The display device of claim 4, wherein:

the node controller further comprises a first reset line discharge controller including:

a gate electrode connected to a second reset signal input line;

a drain electrode connected to the first reset signal input line; and a source electrode connected to the gate-low voltage input line; and the first reset line discharge controller is configured to discharge the first reset signal input line to the second low-potential voltage in response to a turn-on voltage applied to the second reset signal input line at a start of an active period.

7. The display device of claim 4, wherein the node controller further comprises a first reset line voltage holder including:

a gate electrode configured to receive a gate clock bar signal;

a drain electrode connected to the first reset signal input line; and a source electrode connected to the gate-low voltage input line.

8. The display device of claim 4, wherein the first stage further comprises a Q node discharge controller configured to discharge the Q node voltage to the first low-potential voltage in response to the voltage at the gate-low voltage input line.

9. A method of operating a display device including a pixel array including data lines and gate lines and pixels in a matrix, the pixels being at intersections of the data lines and gate lines, the method comprising:

supplying respective gate pulses to the gate lines sequentially by a shift register including a plurality of stages connected as a cascade;

controlling nodes in the shift register by a node controller, the node controller including:

a first reset signal generator including:

a gate electrode connected to a gate-low voltage input line;

a drain electrode connected to a high-potential voltage input line; and a source electrode connected to the first reset signal input line;

charging the output in response to a voltage on a Q node to output a first gate pulse by a pull-up transistor in a first stage among the plurality of stages;

discharging the output to a gate-low voltage in response to a QB node voltage by a pull-down transistor in the first stage;

pre-charging the Q node in response to a start pulse or a gate pulse other than the first gate pulse by a start controller in the first stage;

discharging the QB node to a first low-potential voltage in response to a voltage at a first reset signal input line by a QB node discharge controller in the first stage; and charging the first reset signal input line by the first reset signal generator in response to a turn-on voltage applied to the gate-low voltage input line during a vertical blanking interval of each frame.

10. The method of claim 9, wherein the first reset signal input line floats when the first reset signal generator is turned off.

11. The method of claim 9, wherein the node controller is disposed at a side of the shift register in the display panel.

12. The method of claim 9, further comprising receiving, by the gate-low voltage input line, a second low-potential voltage having a voltage level lower than the first low-potential voltage, except during the vertical blanking interval of each stage.

13. The method of claim 12, wherein the second low-potential voltage is at a same voltage level as the low-potential voltage of a gate clock applied to the drain electrode of the pull-up transistor.

14. The method of claim 12, wherein:

the node controller further comprises:

a first reset line discharge controller including a gate electrode connected to a second reset signal input line;

a drain electrode connected to the first reset signal input line; and a source electrode connected to the gate-low voltage input line; and the method further comprises discharging, by the first reset line discharge controller, the first reset signal input line to the second low-potential voltage in response to a turn-on voltage applied to the second reset signal input line at a start of an active period.

15. The method of claim 12, wherein the node controller further comprises a first reset line voltage holder including:

a gate electrode receiving a gate clock bar signal;

a drain electrode connected to the first reset signal input line; and a source electrode connected to the gate-low voltage input line.

16. The method of claim 12, further comprising, in response to the voltage at the gate-low voltage input line, discharging, by a Q node discharge controller in the first stage, the Q node voltage to the first low-potential voltage.

* * * * *